US005839172A

United States Patent [19]

Takizawa et al.

[11] Patent Number: 5,839,172

[45] **Date of Patent: *Nov. 24, 1998**

[54] HOOK STRUCTURE FOR MOLDED SURFACE FASTENER

[75] Inventors: Toshiaki Takizawa; Keisuke Sakakibara; Mitsuru Akeno; Ryuichi Murasaki; Tsuyoshi Minato, all of Toyama-ken, Japan

[73] Assignee: YKK Corporation, Tokyo, Japan

[ * ] Notice: The term of this patent shall not extend beyond the expiration date of Pat. No. 5,657,517.

[21] Appl. No.: 604,579

[22] Filed: Feb. 21, 1996

[30] Foreign Application Priority Data

Feb. 28, 1995 [JP] Japan ..... 7-039611

[51] Int. Cl.[6] ..... A44B 18/00

[52] U.S. Cl. ..... 24/452; 24/442; 24/450

[58] Field of Search ..... 24/306, 442–452, 24/575–577

[56] References Cited

U.S. PATENT DOCUMENTS

| | | | |
|---|---|---|---|
| D. 374,609 | 10/1996 | Akeno | D8/382 |
| D. 374,813 | 10/1996 | Akeno | D8/382 |
| 3,762,000 | 10/1973 | Menzin et al. | 24/452 |
| 5,131,119 | 7/1992 | Murasaki et al. | 24/452 |
| 5,315,740 | 5/1994 | Provost | 24/452 |
| 5,339,499 | 8/1994 | Kennedy et al. | 24/452 |
| 5,361,462 | 11/1994 | Murasaki | 24/452 |
| 5,457,856 | 10/1995 | Murasaki | 24/452 |
| 5,537,720 | 7/1996 | Takizawa et al. | 24/452 |
| 5,537,723 | 7/1996 | Yoshida et al. | 24/452 |
| 5,551,130 | 9/1996 | Tominaga et al. | 24/452 |

FOREIGN PATENT DOCUMENTS

| | | |
|---|---|---|
| 0 642 749 | 3/1995 | European Pat. Off. . |
| 0 702 909 | 3/1996 | European Pat. Off. . |
| 2 291 114 | 1/1996 | United Kingdom . |

*Primary Examiner*—Peter M. Cuomo
*Assistant Examiner*—Robert J. Sandy
*Attorney, Agent, or Firm*—Hill, Steadman & Simpson

[57] ABSTRACT

A surface fastener molded of synthetic resin, comprises a substrate sheet, and a multiplicity of hook elements molded on at least one surface of the substrate sheet, each hook element having a hook body having a stem and a curved portion. Each of the hook elements has first and second reinforcing ribs projecting from opposite side surfaces of the hook body. The first reinforcing rib is greater in height than the second reinforcing rib. In the presence of the first and second reinforcing ribs different in height, compression stresses developed in the hook body are dispersed at two or more points when a companion engaging element is removed off the hook element.

7 Claims, 4 Drawing Sheets

HOOK STRUCTURE FOR MOLDED SURFACE FASTENER

BACKGROUND OF THE INVENTION

1. Field of the Invention

This invention relates to a synthetic resin surface fastener molded by injection moldng or extrusion molding. More particularly, it relates to a molded surface fastener which is kept from deformation or damage due to repeated use and which has a large engaging strength.

2. Description of the Related Art

In recent years, molded surface fasteners of the above-described type have become much more popular, as substitution for the conventional woven or knit surface fasteners made of filaments, as new fasteners for industrial materials in various kinds of industrial fields. So, various demands have been made with this kind of molded surface fastener. For instance, for use as fasteners for industrial materials, it is absolutely essential to increase the rigidity of each the hook element and also to increase its rate of engagement. On the other hand, for use as fasteners for daily goods such as clothing and paper diapers, it is necessary to give adequate softness to the hook element so that the engaging strength cannot be lowered even in repeated use.

Many proposals have been made to cope with these demands. Such proposals are exemplified by U.S. Pat. Nos. 4,725,221; 4,872,243; 5,131,119; and 5,339,499.

The hook element disclosed either in U.S. Pat. Nos. 4,725,221 or 4,872,243 has a simple hook shape composed of an ordinary stem and a curved portion arcuately extending forwardly from the stem, while the hook element disclosed in U.S. Pat. No. 5,131,119 has opposite (in a transverse direction of a hook element row) reinforcing ribs of the same shape integrally projecting from opposite surfaces of a hook body, which is composed of a stem and a curved portion. These reinforcing ribs serve to prevent the stem from falling flat and also to increase the rigidity of the stem and the toughness of the base of the stem in particular as well as to give the curved portion a predetermined degree of engaging strength. The hook element of U.S. Pat. No. 5,339,499 is similar to the foregoing hook elements but is different in that the stem has a uniform thickness double the thickness of the curved portion; that is, the curved portion has a uniform thickness half the thickness of the stem all the way to the upper end of the stem. With the last-mentioned structure, it is possible to remove the hook elements smoothly from a die during the molding of a molded surface fastener and also to prevent each hook element from being damaged when the surface fastener are brought into and out of engagement with a companion surface fastener.

Many of the companion surface fasteners to be engaged with the above-mentioned molded surface fasteners are female surface fasteners each having a multiplicity of loop elements formed of multifilaments or other molded surface fasteners each having the same structure as the above-mentioned molded surface fasteners. Using these male and female surface fasteners, it is possible to detatchably attach two separate members or elements.

However, when the companion engaging elements are removed off the hook elements of the surface fastener, the individual companion engaging element moves toward the tip of the curved portion along the inner surface of the curved portion with deforming the curved portion into a less curved form. Accordingly stresses developed in the hook element are concentrated at a single point when the surface fastener is removed off the companion surface fastener. This causes the hook element to bend at the point where the stresses are concentrated, so that resiliency may be lost at the bending point by repeated use. Thus the hook element would tend to be damaged, often lowering the engaging strength sharply.

The position of the bending point, which depends on the shape of the hook element, is constant in hook elements of the same shape. Such bending points can be easily found when studying how stresses are distributed in the hook element. FIG. 7 of the accompanying drawings shows a bending point of the simple-shape hook element of U.S. Pat. No. 4,872,243 when removing the companion loop element. FIG. 8 shows dibstribution of stress of the hook element of U.S. Pat. No. 5,131,119. As is apparent from FIGS. 7 and 8, not only in the simple-shape hook element 30 devoid of any reinforcing rib but also in the hook element 300 having the reinforcing ribs 320, compression stresses are concentrated at a single point P, where the hook element is bent. In the hook element 300 having the reinforcing rib 320 in particular, the single bending point P is located near the apex of the reinforcing rib 320.

SUMMARY OF THE INVENTION

With the foregoing conventional problems in view, it is a primary object of this invention is to provide a hook structure which can minimize possible damages that might be caused when hook elements are bent in a molded surface fastener.

In order to accomplish the above object, according to this invention, there is provided a surface fastener molded of synthetic resin, comprising a substrate sheet and a multiplicity of hook elements molded on at least one surface of the substrate sheet,each hook element having a hook body having a stem and a curved portion. Each of the hook elements having first and second reinforcing ribs projecting from opposite side surfaces (in a transverse direction of a hook element row) of the hook body, the first reinforcing rib being greater in height than the second reinforcing rib.

Preferably, the first reinforcing rib has a height greater than the height of a lower surface of a tip of the curved portion of the hook body. More preferably, an apex of the first reinforcing rib projects upwardly from a rear surface of the hook body. Further, the first and/or second reinforcing ribs have on outer surfaces of their opposite side portions one or more auxiliary reinforcing ribs in such a manner that each pair of the hook elements of adjacent hook element rows are connected to each other by the auxiliary reinforcing rib.

Preferably, the substrate sheet has in hook-element-existing surface thereof a plurality of recesses spaced at predetermined distances along the hook element rows, each bottom surface of the recesses connecting confronting front and rear bases of the stems of adjacent front and rear hook bodies of the hook elements arranged in one hook element row. Further, each of the recesses has such a width as to lead a companion engaging element into the recess.

As a significant feature of the molded surface fastener of this invention, the hook body of each hook element has on at least one side surface a reinforcing rib.

With this reinforcing rib, adequate softness of the curved portion of the hook element can be secured, while adequate rigidness of the base of the stem of the hook element can be secured, thus making the hook element sufficiently resistant against falling flat. The hook element may have first and second reinforcing ribs one on each of opposite side surfaces to increase the rigidness. But if the first and second reinforcing ribs have the same height, compression stresses acting on the hook body when the companion engaging element, e.g. loop, is released from the hook element are concentrated in a common point near the apices of the two reinforcing ribs so that the hook body will be bent at one point yet. As a result, the hook body can only have substantially the same durability as that of the conventional one due to the concentrated stresses.

The present inventors made various studies to improve the durability and discovered that if the stresses can be dispersed, the bending points are necessarily be dispersed. The inventors then continued the studies to find any effective means for dispersing the stresses and finally reached the conclusion that the above-mentioned hook structure would be suitable from a view point of production cost and rate. Namely, the most important structural feature of this invention resides in that the first and second reinforcing ribs are different in height though a structure of the hook body provided with the reinforcing ribs is not specified. Basically the first and second reinforcing ribs should not be specified either in shape or in measurement also. Thus according to this invention, applying such structure that the hook body has on its opposite sides surfaces two reinforcing ribs different in height, it is possible to disperse the stresses, which act on the hook body when the companion engaging element, e.g. loop element, is removed from the hook element, in at least two points near the respective apices of the two reinforcing ribs.

FIGS. 2A, 2B and 2C schematically show how the hook body acts in its height direction when the companion engaging element, e.g. loop element, is removed from the hook element. At that time, compression stresses act in two points on the rear side of the hook body near the respective apices of the first and second reinforcing ribs different in height, as shown in FIG. 2A. Since the total compression stress occurring at the bending portion of the hook body would become smaller by a certain degree as compared with that of the conventional hook element, it is possible to improve the durability by such degree for repeated use.

The above-mentioned structure gives good results also with the curved portion of the hook element. Specifically, when the companion engaging element moves to the curved portion of the hook body of FIG. 2A, the axis of the hook body is deviated sideways by a distance t off the central position of the hook body, as shown in FIG. 2B, at the upper portion of the stem where only the first reinforcing rib exists on one side surface of the hook body, though the axis of the hook body is located at the central position of the hook body, as shown in FIG. 2C, where the first and second reinforcing ribs exist on opposite side surfaces of the hook body. When the curved portion of the hook body is pulled upwardly from its inner side by the companion engaging portion, a couple which gives a twist about the axis acts on the portion of the stem where only the first reinforcing rib exists. This means that the curved portion of the hook element is turned about the center of the hook body as pulled upwardly by the companion engaging element, which facilitates removing of the companion engaging element from the curved portion.

Further the second reinforcing rib has, in addition to the function of increasing the rigidness of the stem of the hook element, the following function. Since the second reinforcing rib projects from the hook body, the companion engaging element will not move toward the upper surface of the substrate sheet after it has reached the stem, so that the possibility of widening the loop of the companion engaging element by the stem would be increased, thus improving the rate of engagement with the companion engaging elements.

BRIEF DESCRIPTION OF THE DRAWINGS

FIGS. 24A, 2B and 2C are a side view, and horizontal cross-sectional views taken along the II—II and III—III lines, respectively, of the hook element of FIGS. 1A and 1B, showing two different points of bending;

DETAILED DESCRIPTION OF THE PREFERRED EMBODIMENTS

Figure 1A:
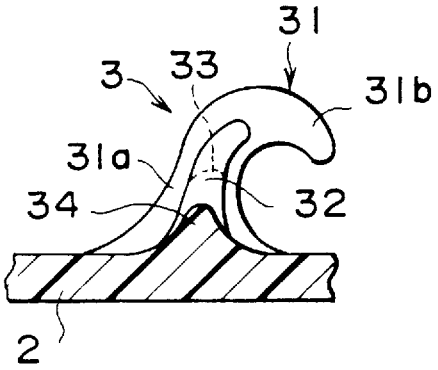
FIGS. 1A and 1B are left and right side views of a hook element according to a first embodiment of this invention.
Figure 1B:
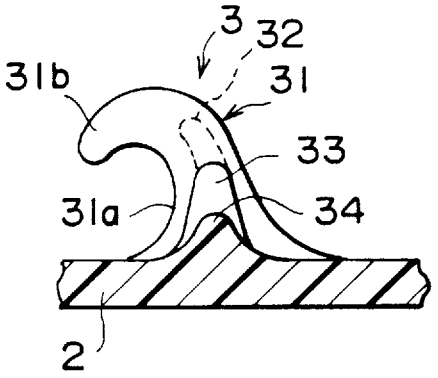

Preferred embodiments of this invention will now be described in detail with reference to the accompanying drawings. FIGS. 1A, 1B, 2A, 2B and 2C show a first embodiment of this invention. Specifically, FIG. 1A is a leftside vertical cross-sectional view of a hook element of a molded surface fastener according to a first embodiment, taken along a leftside auxiliary reinforcing rib, and FIG. 1B is a rightside vertical cross-sectional view of the hook element taken along a right-side auxiliary reinforcing rib. According to the illustrated surface fastener 1, a multiplicity of rows of hook elements 3 are molded on an upper surface of a substrate sheet 2, standing with their hooks facing in a common direction. Like reference numerals designate similar parts or elements throughout several views of different embodiments.

The hook element 3 has a hook body 31, first and second reinforcing ribs 32, 33 projecting from left and right side surfaces (front and rear surfaces in FIG. 1A) of the hook body 31, and an auxiliary reinforcing rib 34 connecting the first and second reinforcing ribs 32, 33 adjacent to and confronting with each other in adjacent hook element rows. The hook body 31 has a stem 31*a* having a varying width (sideways) gradually decreasing from its base toward its upper end, and a curved portion 31*b* continuously curving from the upper end of the stem 31*a* in such a manner that its tip faces toward the upper surface of the substrate sheet 2.

The first reinforcing rib 32 projecting from the left side surface of the hook body 31, as shown in FIG. 1A, gently rises substantially centrally from the base of the hook body 31, with a varying width gradually decreasing upwardly, then extends vertically upwardly with a substantially uniform width, and finally extends halfway to the tip of the curved portion 31*b* along the central line of the curved portion 31*b*. The second reinforcing rib 33 projecting from the right side surface of the hook body 31, as shown in FIG. 1B, gently rises substantially centrally from the base of the hook body 31, with a varying width gradually decreasing upwardly likewise the first reinforcing rib 31, then extends vertically upwardly with a slightly reduced width, and terminates in an apex substantially equal in height to the height of a lower surface of the tip of the curved portion 31*b*. As a result, there exists a difference in height between the apices of the first and second reinforcing ribs 32, 33.

Figure 2A:
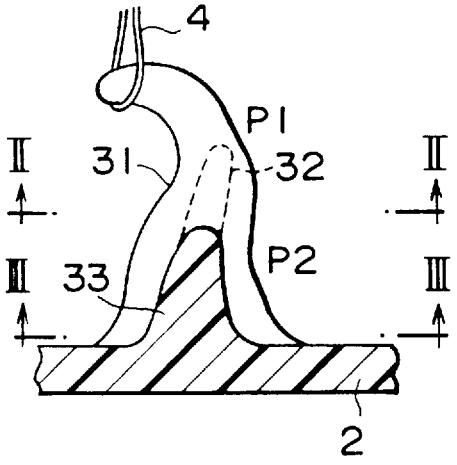
Figure 2B:
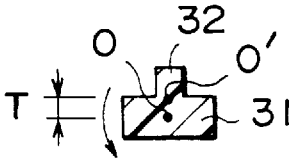
Figure 2C:
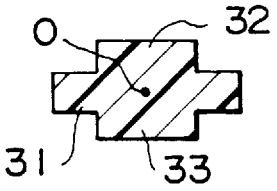

FIGS. 2A, 2B and 2C show how the hook element 3 of the first embodiment acts and bends when a loop element 4 as a companion engaging element is removed off the hook element 3. At that time, compression stresses developed on the hook body 31 are concentrated at two points P1, P2 on the rear surface of the hook body 31 adjacent to the respective apices of the first and second reinforcing ribs 32, 33 different in height, as shown in FIG. 1A. Therefore, the compression stresses, which would have been concentrated at one point in the case of the conventional hook element, are dispersed in this invention, and as a result, the individual compression stress developed in the respective bending point P1, P2 would be reduced, thus causing an improved degree of durability against repeated use.

With the foregoing structure, the hook element 3 can be removed smoothly from the loop element 4. FIGS. 2B and 2C show the mechanism for facilitating removal of the loop element 4 from the hook element 3. When the companion engaging element is moved to the curved portion of the hook body 31 of FIG. 2A, the axis 0 of the hook element 3 coincides with the central line of the hook body 31 at the lower part of the stem 31*a* of the hook element 3, where there are first and second reinforcing ribs 32, 33 on opposite side surfaces, as shown in FIG. 2C. In the meantime, the axis 0 of the hook element 3 is displaced sideways by a distance T off the central position of the hook body 31, as indicated by the axis 0', at the upper part of the stem 31*a*, where there exists only the first reinforcing rib 32 on one side surface of the hook body 3, as shown in FIG. 2B. Therefore, if the loop element 4 is pulled upwardly from the inner side of the curved portion 31*b*, a couple acts on the hook body portion having only the first reinforcing rib 32 so as to turn the hook body portion about the axis in a direction indicated by an arrow in FIG. 2B so that the hook body portion is twisted. This means that the curved portion 31*b* of the hook element 3 is turned about the stem 31*a* of the hook body 31 due to the upward pulling force of the hook element 4, thus keeping the hook and loop elements 3, 4 free from any damage and facilitating removal of the loop element 4 off the curved portion 31*b*.

The second reinforcing rib 33 serves, in addition to the function of increasing the rigidity of the base of the stem 31*a* of the hook element 3, to increase the rate of engagement. Namely, since the second reinforcing rib 33 projects from the hook body 31, its apex blocks the loop element 4 from entering between adjacent the hook elements 3 and makes the loop shape of the loop element 4 wider when the loop element 4 further enters, thus increasing the rate of engagement of the loop element 4 with either of the adjacent hook elements 3.

In the first embodiment, the hook element 3 has a pair of auxiliary reinforcing ribs 34 on the respective outer surfaces of the first and second reinforcing ribs 32, 33, and each pair of hook elements 3 of adjacent hook element rows are interconnected by the confronting auxiliary reinforcing ribs 34. With this arrangement, it is reliably possible to prevent the hook element 4 from falling flat and also to prevent the substrate sheet 2 from being torn between hook element rows.

Figure 3A:
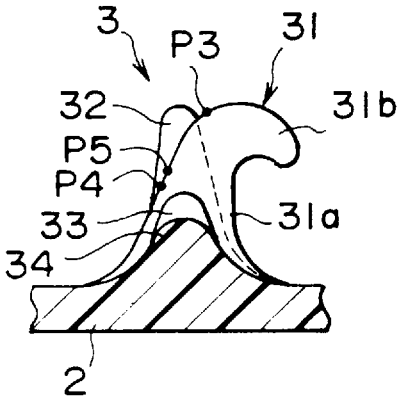
FIGS. 3A and 3B are side and front views, respectively, of a hook element according to a second embodiment.
Figure 3B:
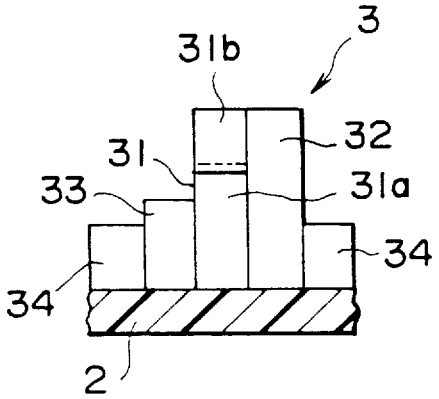

FIGS. 3A and 3B show a hook element according to a second embodiment of this invention. FIG. 3(*a*) is a left side view showing the hook element 3 along with a substrate sheet 2, and FIG. 3B is a front view showing the hook element 3 along with the substrate sheet 2. In the second embodiment, like the first embodiment, the first reinforcing rib 32 rises from the base of the hook body 31 with a varying width gradually decreasing upwardly along with that of the hook body 31, and has an apex substantially equal in height to the top point of the hook body 31. Accordingly, since a part of the first reinforcing rib 32 projects upwardly from the rear surface (leftside surface in FIG. 3A) of the hook body 31, compression stresses are dispersed at upper and lower points P3, P4.

On the other hand, the second reinforcing rib 33 rises from the base of the hook body 31 with a varying width gradually decreasing upwardly along with that of the hook body 31 and extends up to a point substantially two thirds in height of the stem 31*a*. Accordingly, compression stresses developed on the hook body 31 by the second reinforcing rib 33 are concentrated at a point P5 near the apex of the second reinforcing rib 33 on the rear surface of the hook body 31, in addition to the two bending points P3, P4 of the first reinforcing rib 32, so that the compression stresses can be dispersed at such an increased number of points as compared with the first embodiment.

The auxiliary reinforcing rib 34, like the first and second reinforcing ribs 32, 33, rises from the base of the hook body 31 with a varying width gradually decreasing upwardly along with that of the hook body 31 and extends to a point substantially a half in height of the stem 31*a*. As apparent from FIG. 3B, each pair of hook elements 3 of of adjacent hook element rows are interconnected by the confronting auxiliary reinforcing ribs 34.

Figure 4:
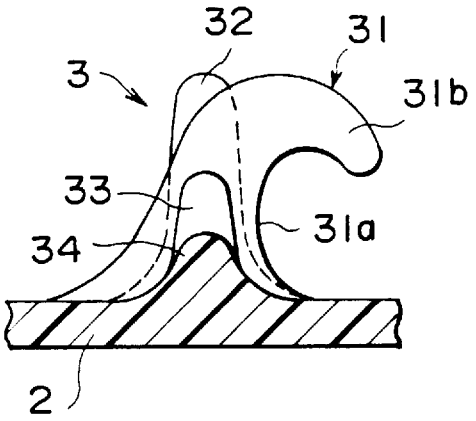
FIG. 4 is a left side view of a modification of the hook element of the second embodiment.

FIG. 4 shows a modification of the hook element of the second embodiment. According to the modification, each of the first, second and auxiliary reinforcing ribs 32, 33, 34 has a width, at the base, smaller than that of the stem 31*a* of the hook body 31 and rises from the base of the hook body 31 at a position slightly forwardly (rightwardly) of its center. In the case of this modification, like the second embodiment, compression stresses are dispersed at three points when the companion engaging element is removed off the hook element, and the base of the hook element 3, particularly the base of the hook body 31, has an adequate degree of softness.

Figure 5:
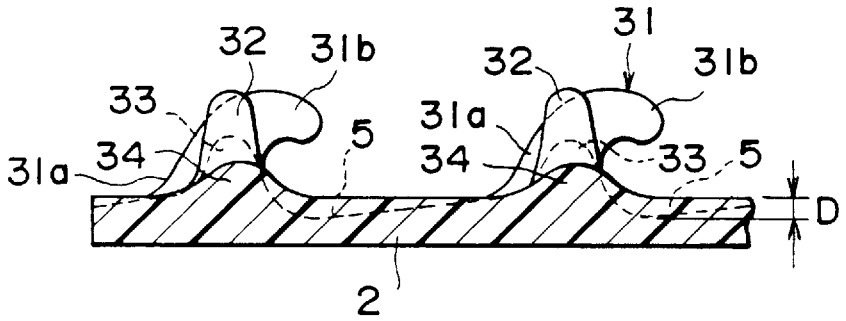
FIG. 5 is a fragmentary side view of a hook element row according to a third embodiment.
Figure 6:
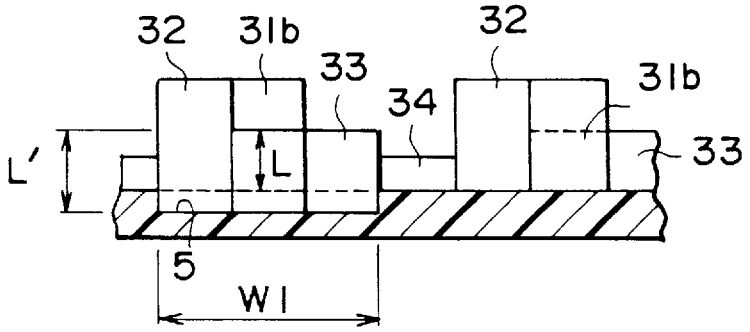
FIG. 6 is a fragmentary front view of the hook element row of the third embodiment.

FIGS. 5 and 6 show a third embodiment. According to the third embodiment, the substrate sheet 2 has in its hook-element-existing surface a plurality of substantially rectangular recesses 5 spaced at predetermined distances along the hook element rows, each bottom surface of the recesses 5 extending between the confronting front and rear bases of at least the stems 31*a*, 31*a* of the adjacent front and rear hook bodies 31, 31. Specifically, in adjacent front and rear hook elements 3 in the same hook element row, as indicated by dotted lines in FIG. 5, the front base of the stem 31*a* of the rear hook body 31 rises backwardly, with a predetermined curvature, from the bottom surface of the recess 5 in the substrate sheet 2, while the rear base of the stem 31*a* of the front hook body 31 rises forwardly, with a gentle curve, from the bottom surface of the recess 5 in the substrate sheet 2. Each hook element 3 has a curved portion 31*b* extending forwardly from the upper end of the stem 31*a* and curving downwardly, and the upper part of the stem 31*a* and the whole of the curved portion 31*b* project upwardly from the upper surface of the substrate sheet 2.

Further, each of the recesses 5 has at least such a width as to lead a companion engaging element into the recess 5. In this embodiment, as shown in FIG. 5, the base of the hook body 31 and bases of first and second reinforcing ribs 32, 33 integrally project upwardly from the bottom surface of the recess 5 in the substrate sheet 2. Namely, the recess 5 has a width W1 equal to the distance between the respective outer side surfaces of the first and second reinforcing ribs 32, 33, which are respectively provided on opposite side surfaces of the stem 31*a* of the hook element 3 and have a chevron side shape. The hook element 3 of this embodiment is substantially identical in structure of the modification of FIGS. 3A and 3B. Namely, the hook element 3 has a pair of auxiliary reinforcing ribs 34 on the respective outer surfaces of the first and second reinforcing ribs 32, 33, each reinforcing rib 34 rising straight from the upper surface of the substrate sheet 2. The confronting auxiliary reinforcing ribs 34 of adjacent hook elements 3 in adjacent hook element rows are connected with each other. Each of the first, second and auxiliary reinforcing ribs 32, 33, 34 has a width, at the base, smaller than that of the stem 31a of the hook body 31, and rises from a position slightly forwardly of the center of the base of the hook body 31. This embodiment has, in addition to the functions similar to those of the foregoing embodiments, the following functions.

The recess 5 has a varying depth gradually increasing from the rear surface of the front hook element 3 toward the rear adjacent hook element 3. With this recess 5, the hook 3 can yield without difficulty when the companion loop element 4 is removed off the hook element 3. Although the distance L' between the lower surface of the tip of the curved portion 31*b* of the hook body 31 and the base (the bottom surface of the recess 5 of the stem 31*a* is equal to that of the conventional hook element, the distance L between the lower surface of the tip of the curved portion 31*b* and the upper surface of the substrate sheet 2 is equal to the difference between the distance L' corresponding to the substantial height of the hook 3 and the depth D of the recess 5. Though it is identical in measurement with the conventional hook element, the height of the hook element 3 projecting from the upper surface of the substrate sheet 2 is smaller than that of the conventional one by the difference between the substantial height of the hook element 3 projecting from the bottom surface of the recess 5 and the depth D of the recess 5. When the hook element 3 of this embodiment comes into engagement with the companion loop element 4, the end of the loop element 4 enters under the curved portion 31*b* to the base of the stem 31*a* of the hook body 31 as guided by the recess 5. Thus the curved portion 31*b* is smoothly inserted through the loop element 4 to assume the same engagement with the loop element 4 as conventional.

Figure 7:
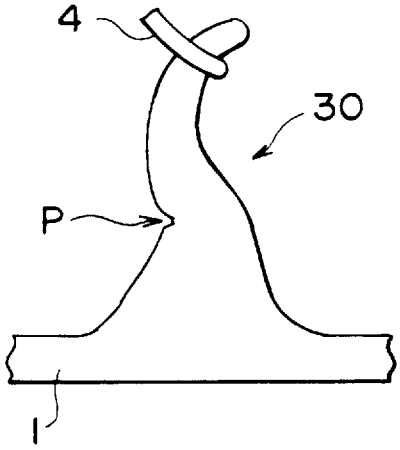
FIG. 7 PRIOR ART
FIG. 7 is a side view of a conventional hook element without a reinforcing rib, showing how the conventional hook element is bent when a companion loop element is removed from the hook element.
Figure 8A:
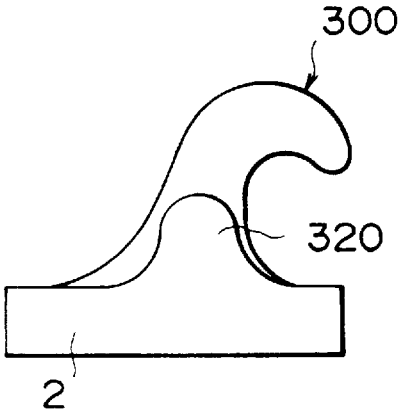
FIG. 8A PRIOR ART
FIGS. 8A and 8B show stress distribution in a conventional hook element with a reinforcing rib when the companion loop element is removed off the reinforcing hook element.
Figure 8B:
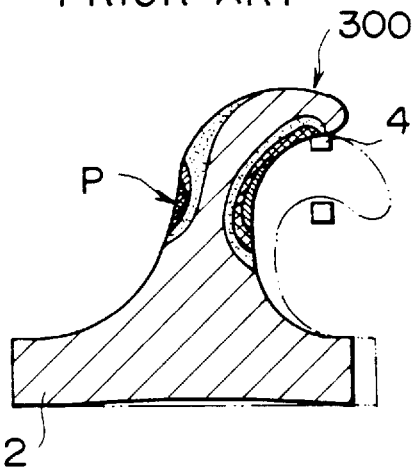
FIG. 8B PRIOR ART

Another advantageous feature of this embodiment resides in that the loop element 4 can be automatically led under the curved portion 31*b* of the hook 3. Since the rear surface of the stem 31*a* of the hook body 31 rises obliquely with a gentle curve, the loop element 4 pressed against the rear surface of the stem 31*a* is led into the recess 5 along the rear surface and hence enters under the curved portion 31*b* of the hook element 3 existing on the rear side of the loop element 4, thus causing an improved rate of engagement. Further, since the hook element 3 has a varying cross-sectional area gradually decreasing from the base of the stem 31*a* of the hook body 31 to the tip of the curved portion 31*b*, the part of hook element 3 projecting from the upper surface of the substrate sheet 2 is relatively smaller in size so that the hook element 3 has adequate softness with maintaining the same degree of engaging strength as the conventional hook elements 30, 300 of FIGS. 7 and 8.

As is apparent from the foregoing description, as long as there exist on opposite side surfaces of the hook body 31 the first and second reinforcing ribs 32, 33 different in height, the shape and size of the hook body 31 should by no means be limited to the illustrated examples, and various modifications may be suggested.

With the above-mentioned arrangement, since compression stresses developed in the hook element 3 during removing off the companion engaging element are dispersed at two or more points without concentrating at a single point, the bending points also are dispersed so that the hook element 3 can be kept free from any damage even at the bending points when a removing force is exerted on the hook element as conventional and can be adequately durable against repeated use. By selecting an appropriate combination of the first, second and auxiliary reinforcing ribs 32, 33, 34, an appropriate shape and size of the individual reinforcing rib 32, 33 34, and an appropriate shape of the substrate sheet 2 it is possible to secure an increased rate of engagement as compared to the conventional hook structure.

As an additional advantageous result of this invention, when the loop element 4 pulls up the curved portion 31*b* of the hook element 3 from the inner side, a couple acts on the hook body portion where only the first reinforcing rib 32 exists, so as to turn that hook body portion about the axis of the hook element 3, thus causing a twist in the hook body portion. Accordingly the curved portion 31*b* of the hook element 3 is turned or rotated about the stem 31*a* of the hook body 31 due to the upward pulling force by the loop element 4 so that the removing of the loop element 4 from the curved portion 31*b* is facilitated, reducing damages of hook and loop elements 3, 4.

What is claimed is:

1. A surface fastener molded of synthetic resin, comprising:

(a) a substrate sheet; and (b) a multiplicity of hook elements molded on at least one surface of said substrate sheet, each hook element having a hook body having a stem and a curved portion;

(c) each of said hook elements having first and second reinforcing ribs projecting from opposite side surfaces of said hook body;

(d) said first reinforcing rib being greater in height than said second reinforcing rib.

2. A molded surface fastener according to claim 1, wherein said first reinforcing rib has a height greater than the height of a lower surface of a tip of said curved portion of said hook body.

3. A molded surface fastener according to claim 1, wherein an apex of said first reinforcing rib projects upwardly from a rear surface of said hook body.

4. A molded surface fastener according to claim 1, wherein one of said first and second reinforcing ribs has on an outer surface of an opposite side portion thereof from said side surface of said hook body, an auxiliary reinforcing rib.

5. A molded surface fastener according to claim 4, wherein a plurality of pairs of said hook elements in adjacent hook element rows in a transverse direction are each connected together by said auxiliary reinforcing rib.

6. A molded surface fastener according to claim 1, said substrate sheet has in hook-element-exisiting surface thereof a plurality of recesses spaced at predetermined distances along hook element rows, each bottom surface of said recesses connecting confronting front and rear bases of said stems of adjacent front and rear hook bodies of said hook elements arranged in one hook element row.

7. A molded surface fastener according to claim 6, each of said recesses has such a width as to lead a companion engaging element into said each recess.

* * * * *